United States Patent [19]

Cross

[11] 3,990,573

[45] Nov. 9, 1976

[54] TRAVEL KIT AND GAME

[76] Inventor: James M. Cross, 2277 Glencoe Hills Drive, Apt. No. 11, Ann Arbor, Mich. 48104

[22] Filed: July 25, 1975

[21] Appl. No.: 599,057

[52] U.S. Cl. ..... 206/315 R; 273/176 FB; 190/42

[51] Int. Cl.[2] ..... B65D 85/00; A63D 67/02; A45C 15/00

[58] Field of Search ..... 190/51, 42, 1; 206/315, 206/223; 273/176 FB

[56] References Cited

UNITED STATES PATENTS

| | | | |
|---|---|---|---|
| 2,486,536 | 11/1949 | Olson | 190/42 |
| 3,306,405 | 2/1967 | Rosenblum | 190/51 |
| 3,347,346 | 10/1967 | Young | 190/42 |
| 3,558,139 | 1/1971 | Brandell | 273/176 FB |
| 3,861,524 | 1/1975 | Coleman | 206/315 |

*Primary Examiner*—Stephen P. Garbe
*Assistant Examiner*—Douglas B. Farrow
*Attorney, Agent, or Firm*—Harness, Dickey & Pierce

[57] ABSTRACT

An executive travel kit comprising a brief case-suit case that houses in one of its cover halves a golf putting game. A detachable brief case is carried in the other half and permits the remainder of this other half to serve as a carrier for clothing items. A built-in case carries cosmetics and toiletries.

12 Claims, 2 Drawing Figures

FIG. 1.
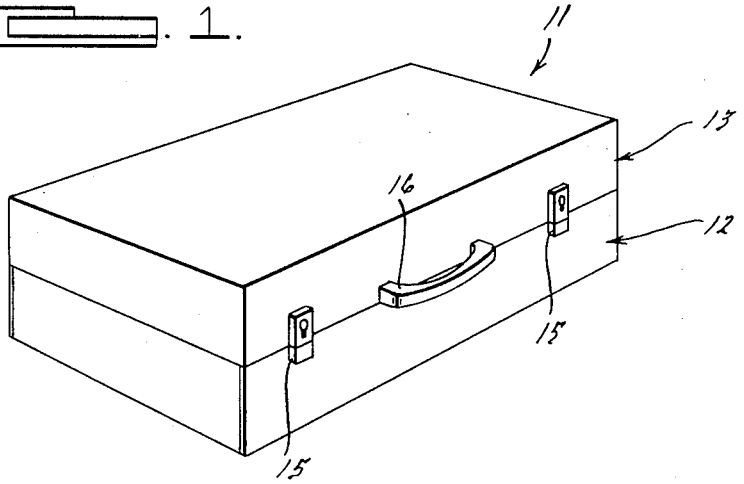
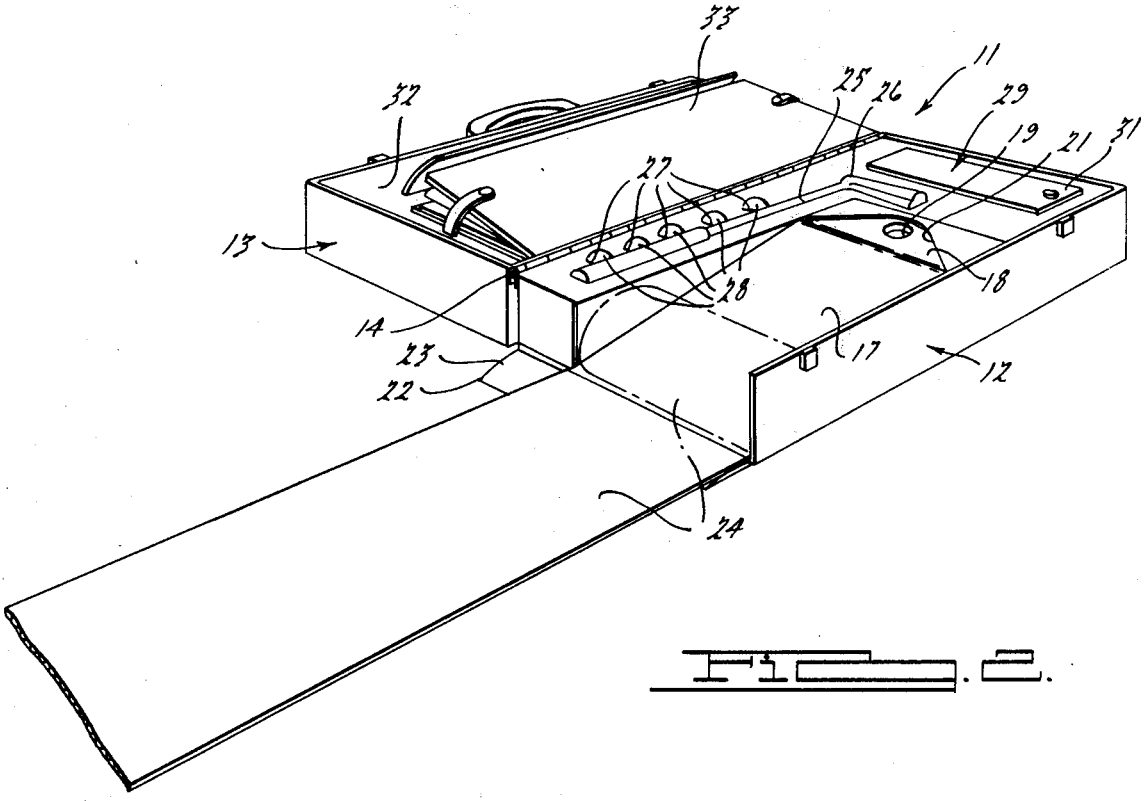
FIG. 2.

TRAVEL KIT AND GAME

BACKGROUND OF THE INVENTION

This invention relates to a combined travel kit and game and more particularly to such a combined device particularly adapted for use by businessmen.

Frequently people, particularly businessmen, are required to make out of town, overnight business trips. At the completion of the business day, the traveler may need some form of relaxation and/or desire to engage in some pastime. This problem is particularly acute with golfers. On a normal business trip, however, it is impossible for a golfer to take a full complement of golf clubs and equipment.

It is, therfore, a principal object of the invention to provide a combined travel kit and game.

It is another object of the invention to provide a compact golf game that also functions as a travel kit.

SUMMARY OF THE INVENTION

This invention is particularly adapted to be embodied in a combined travel kit and game. The kit and game comprise a case comprised of hingedly connected sections and having a carrying handle. One of the sections has an inclined putting surface terminating at an area in which a hole is formed so as to function as a putting game. The one section has a side portion at the lowermost part of the inclined surface that is movable relative thereto to provide access to the inclined section for permitting balls to be putted onto the inclined surface. The other of the sections defines a cavity that is adapted to receive, at least in part, personal objects.

BRIEF DESCRIPTION OF THE DRAWINGS

FIG. 1 is a perspective view of a combined travel kit and game embodying this invention, showing the kit in a closed position.

FIG. 2 is a perspective view of the combined kit and game shown in FIG. 1, illustrating the device in an opened position.

DETAILED DESCRIPTION OF THE PREFERRED EMBODIMENT

The reference numeral 11 indicates generally a combined travel kit and game embodying the invention. The kit is comprised of a lower section 12 and upper section 13 that are connected together along one side by a detachable hinge 14. The detachable hinge 14 is designed so as to permit quick release of the sections 13 and 14 from each other, if desired. Catches 15 are provided for locking the sections 12 and 13 in the closed, carrying position (FIG. 1). In this orientation the kit 11 may be carried by a carrying handle 16 that is affixed in any known manner to the section 13.

Preferably the kit 11 has a size approximating that of a conventional attache case. It is to be understood, however, that the kit 11 may be of any desired size, depending upon the number of articles to be carried. The outer surface of the kit may be covered with leather, decorator fabrics (if intended for use by women) or any other suitable covering material.

FIG. 2 illustrates the kit 11 in an opened condition with the sections 12 and 13 still connected together by the hinge 14. The section 13 has formed within it an inclined surface 17 that may be covered with a rug-like material or something simulating the turf of a putting green. At the high point of the inclined surface 17, a flattened surface 18 is formed in which a hole 19 is provided. The surface 18 is surrounded by a v-shaped portion 21 so that all balls hit onto the surface 18 will be directed into the hole 19. Any known type of ball return device (not shown) may be provided in the section 12 beneath the surface 18. Such devices may be operated either by battery or by household current to return balls from the hole 19. Such devices are well known in the art and, for this reason, will not be described.

A side 22 of the section 12 is connected to the remainder of this section by means of a hinge to be pivotal from a closed position (FIG. 1) to an opened position as shown in FIG. 2. Preferably the exposed surface 23 of the section will be curved or tapered so as to provide a gradual lead-in to the inclined surface 17. If desired, a roll of carpet-like or turf similating material 24 may be carried in the cavity formed by the lower portion of the inclined surface 17 which may be rolled out to provide an extended putting surface.

The section 12 is formed with a recess 25 that is complimentary in shape to and adapted to receive a telescopic putter 26 of any known type. In addition, complimentary recesses 27 are formed to receive a number of golf balls 28. Thus, it should be readily apparent that the section 12 provides all the necessary accouterments for practicing putting. For this reason, the detachable hinge 14 is provided so that the game portion of the kit may be detached from the section 13.

At the end of the section 12 remote from the end wall 22, a compartment 29 is formed that is enclosed by a cover 31. The cover 31 may be pivotal to open the compartment 29. Preferably the compartment 29 and cover 31 are formed with recessed portions so as to contain detachable personal and toilet articles such as soap, electric razor, safety razor, nail files, combs and the like.

The section 13 forms a generally open cavity 32. A detachable brief case 33 is carried in the cavity 32 and separates the remainder of the cavity 32 from the section 13, when the kit 11 is in its closed position. Beneath the brief case 33 articles of clothing or other personal articles may be carried.

It should be readily apparent that the disclosed device comprises not only a self contained business travel kit but also a game that will permit diversion for a business person on a short duration business trip. In addition to the described articles an electronic calculator may be recessed into the section 12. Various other changes and modifications may be made without departing from the spirit and scope of the invention as defined by the appended claims.

I claim:

1. A combined travel kit and game comprising a case comprised of hingedly connected sections having a handle, one of said sections having an inclined putting surface terminating at an area formed with a hole for functioning as a putting game, said one section having a side portion at the lowermost part of said inclined surface movable relative thereto to provide access to such inclined surface for permitting balls to be putted onto said inclined surface, the other of said sections defining a cavity adapted to receive, at least in part, clothing objects, the area formed with the hole being positioned contiguous to the opening of said cavity when said sections are pivoted to their closed position, said inclined surface extending from said hole and away from said cavity mouth when said sections are closed.

2. A combined travel kit and game as set forth in claim 1 wherein the one section further has recesses complimentary to and adapted to receive a golf putter and at least one golf ball.

3. A combined travel kit and game as set forth in claim 2 wherein the sections of the case are detachably connected to each other.

4. A combined travel kit and game as set forth in claim 3 wherein the inclined surface and the complimentary recesses are formed in side-by-side relationship.

5. A combined travel kit and game as set forth in claim 4 wherein the side portion of the one section is hingedly connected to the one section.

6. A combined travel kit and game as set forth in claim 1 wherein the cavity formed by the other of the sections is adapted to detachably receive a brief case.

7. A combined travel kit and game as set forth in claim 6 in combination with a brief case, said brief case being smaller in volume than said cavity for dividing said cavity from said one section.

8. A combined travel kit and game as set forth in claim 1 further including recesses formed with an enclosed compartment in one of said sections adapted to receive personal toilet articles and complimentary in shape thereto.

9. A combined travel kit and game as set forth in claim 8 wherein the enclosed compartment is formed in the one section.

10. A combined travel kit and game as set forth in claim 9 wherein the cavity formed by the other of the sections is adapted to detachably receive a brief case.

11. A combined travel kit and game as set forth in claim 10 in combination with a brief case, said brief case being smaller in volume than said cavity for dividing said cavity from said one section.

12. A combined travel kit and game as set forth in claim 11 wherein the sections of the case are detachably connected to each other.

* * * * *